US007455746B2

(12) United States Patent
Westall

(10) Patent No.: US 7,455,746 B2
(45) Date of Patent: Nov. 25, 2008

(54) METHOD AND INSTALLATION FOR CLINCHING PIECES OF SHEET METAL

(75) Inventor: Roger Westall, Grugliasco (IT)

(73) Assignee: Comau SpA, Turin (IT)

( * ) Notice: Subject to any disclaimer, the term of this patent is extended or adjusted under 35 U.S.C. 154(b) by 430 days.

(21) Appl. No.: 10/939,724

(22) Filed: Sep. 13, 2004

(65) Prior Publication Data

US 2005/0060866 A1 Mar. 24, 2005

(30) Foreign Application Priority Data

Sep. 23, 2003 (IT) ..... TO2003A0726

(51) Int. Cl.
*B29C 65/00* (2006.01)
*B32B 37/00* (2006.01)

(52) U.S. Cl. ..... 156/273.7; 156/479; 901/42

(58) Field of Classification Search ..... 156/479, 156/273.7; 901/42

See application file for complete search history.

(56) References Cited

U.S. PATENT DOCUMENTS 4,551,903 A * 11/1985 Bisiach ..... 483/16
5,587,042 A 12/1996 St. Denis

FOREIGN PATENT DOCUMENTS

| | | |
|---|---|---|
| DE | 19927207 | 12/2000 |
| EP | 0577876 | 1/1994 |
| EP | 0 996 760 | 9/2003 |

OTHER PUBLICATIONS

EP Search Report, Application No. EP 04020970, dated Oct. 28, 2004.

* cited by examiner

*Primary Examiner*—Justin Fischer
(74) *Attorney, Agent, or Firm*—Patterson & Sheridan L.L.P.

(57) ABSTRACT

A method for clinching pieces of metal plate, comprising the steps of:

positioning two pieces of sheet metal (6*a*, 6*b*) in a clinching station (3), the two pieces of sheet metal (6*a*, 6*b*) being provided with at least one area of their edge whereon is applied a hot-curing resin, performing a clinching operation along the edge (16, 17) of said pieces (6*a*, 6*b*); and polymerising the resin by means of induction heating, in the same clinching station (3) by means of a heating device (19) which performs a localised heating of the clinched edges (16, 17).

17 Claims, 5 Drawing Sheets

11
12
19
22
20
7
6
18
23
16
6b
17
6a
23
14
13

METHOD AND INSTALLATION FOR CLINCHING PIECES OF SHEET METAL

CROSS-REFERENCE TO RELATED APPLICATIONS

This application claims benefit of Italian patent application serial number TO2003A000726, filed Sep. 23, 2003, which is herein incorporated by reference.

BACKGROUND OF THE INVENTION

1. Field of the Invention

The present invention relates to a method and an installation for clinching pieces of sheet metal.

The clinching operation is frequently used to connect two pieces of sheet metal to each other, e.g. two metal sheet panels of a component or subassembly of the body of a vehicle, such as the structure of a vehicle door. The two metal sheet panels forming a structure of this kind are mutually joined with a clinching operation performed along the perimeter of the structure or at least along some segments of the perimeter.

According to a typical arrangement, a peripheral edge portion of one of the two pieces of sheet metal is initially bent at 90° and the corresponding edge portion of the other piece has a flat shape and is superposed to the other panel in the immediate vicinity of the edge portion bent at 90°. The clinching operation is typically conducted in two or more successive steps. In a first step, the 90° portion is initially bent towards the other panel by about 45°. In a second step, the portion bent at 45° is further bent by another angle of about 45° in order to be flattened against the edge of the other panel.

2. Description of the Related Art

European Patent Application no. 03001105.0 by the same Applicant (not yet published as of the filing date of the present application) describes a clinching tool of the roll type, mounted on the wrist of an industrial robots that moves the tool along the peripheral edge of the pieces to be clinched.

In many cases, before the clinching operation a hot-curing resin is spread along the entire perimeter or only on some localised areas of the edge to be clinched. The hot-curing resin serves as a sealant and/or structuring agent. After the clinching operation, the piece can be subjected to a heating step to cause the polymerisation of the resin. The heating operation is usually performed in a separate station, different from the station where the clinching operation was performed. A traditional solution provides for the use of an induction furnace including a heating coil which extends along the perimeter of the piece.

However, this known solution is particularly burdensome in the case of small series productions, due to the need to equip an independent heating station.

SUMMARY OF THE INVENTION

The object of the present invention is to provide a method and an installation for clinching pieces of sheet metal which allow to overcome said drawback.

According to the present invention, said object is achieved by a method and by an installation having the characteristics set out in the claims.

BRIEF DESCRIPTION OF THE DRAWINGS

The present invention shall now be described in detail with reference to the accompanying drawings, provided purely by way of non limiting example, in which.

DETAILED DESCRIPTION

Figure 1:
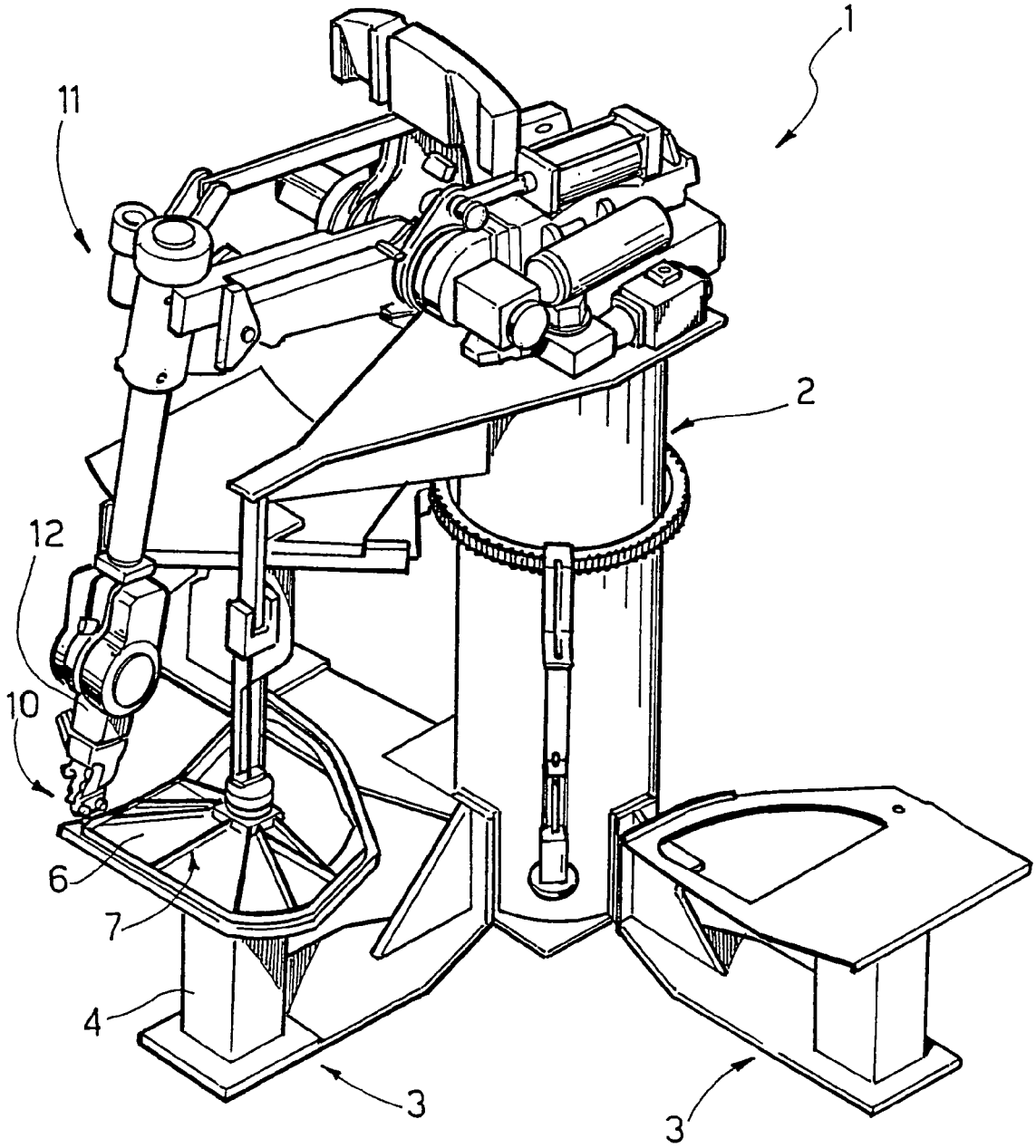
FIG. 1 is a perspective view of a clinching installation according to the present invention.
Figure 2:
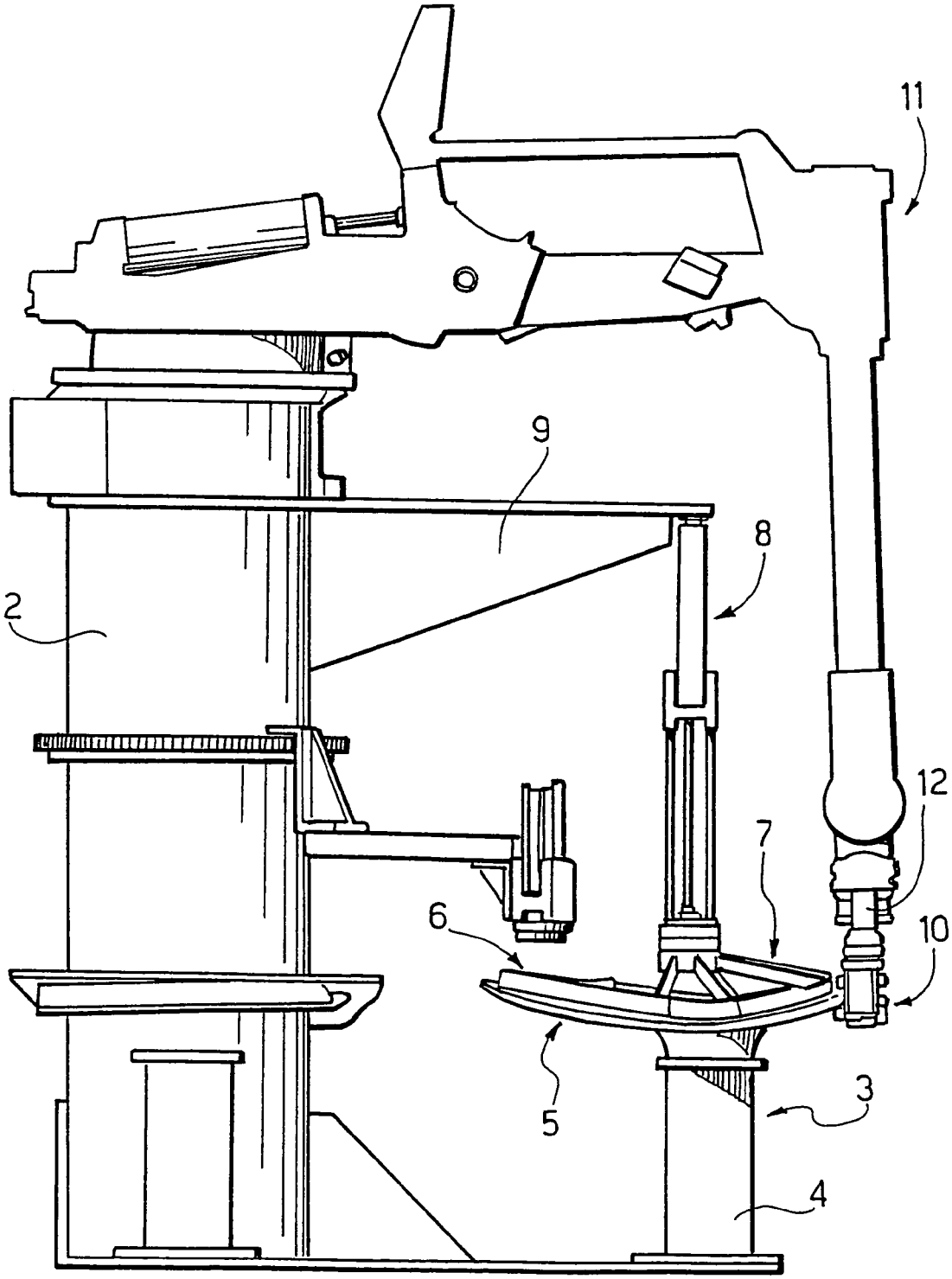
FIG. 2 is an elevation view according to the arrow II of FIG. 1, and FIGS. 3 through 8 are schematic views illustrating some operative steps of the clinching method according to the present invention.

FIGS. 1 and 2 show an installation 1 for clinching pieces of sheet metal. In the illustrated example, the installation 1 is used to produce motor vehicle doors formed by two pieces of sheet metal joined together along at least one portion of their perimeter by means of a clinching operation.

In the example illustrated in FIGS. 1 and 1, the installation 1 is provided with a central column 2 and with at least one clinching station 3. The installation could be provided with a loading station (in which adhesive could be applied), with a clinching station and with an unloading station for the completed piece. FIG. 1 shows two stations positioned around the central column 2.

The or each clinching station 3 has a support 4 bearing a clinching die 5 whereon is supported the structure to be clinched 6 (in the illustrated example, it is constituted by a vehicle door).

The two pieces of sheet metal forming the structure 6 are in mutual contact along their peripheral edge and are maintained in this position by a presser 7 borne at the lower end of a vertical arm 8 supported at its upper end by a bracket 9 connected to the central column 2. The presser 7 is movable in the vertical direction between a raised position and a lowered position.

The two metal plate panels constituting the structure 6 are mutually joined with a clinching operation which is performed by means of a clinching tool 10 borne by the wrist 12 of an industrial robot 11. In the example illustrated in FIGS. 1 and 2, the industrial robot 11 is mounted at the top of the central column 2. However, it should be noted that the structure and the arrangement of the robot 11 may vary widely from what is illustrated herein. In the present description and in the accompanying claims, the expression "industrial robot" must be interpreted in a broad sense, to mean any type of structure which can be displaced along at least one direction in controlled fashion.

The structure and the operation of the clinching tool 10 are not described in detail because they are outside the scope of the present invention. Said operation can be performed as described in detail in European patent application no. 03001105.0 by the same Applicant. Although the use of the clinching tool described herein is a preferred solution, the clinching operation can be performed with any other type of tool.

The method according to the invention shall now be described with reference to the FIGS. from 3 through 8.

Figure 3:
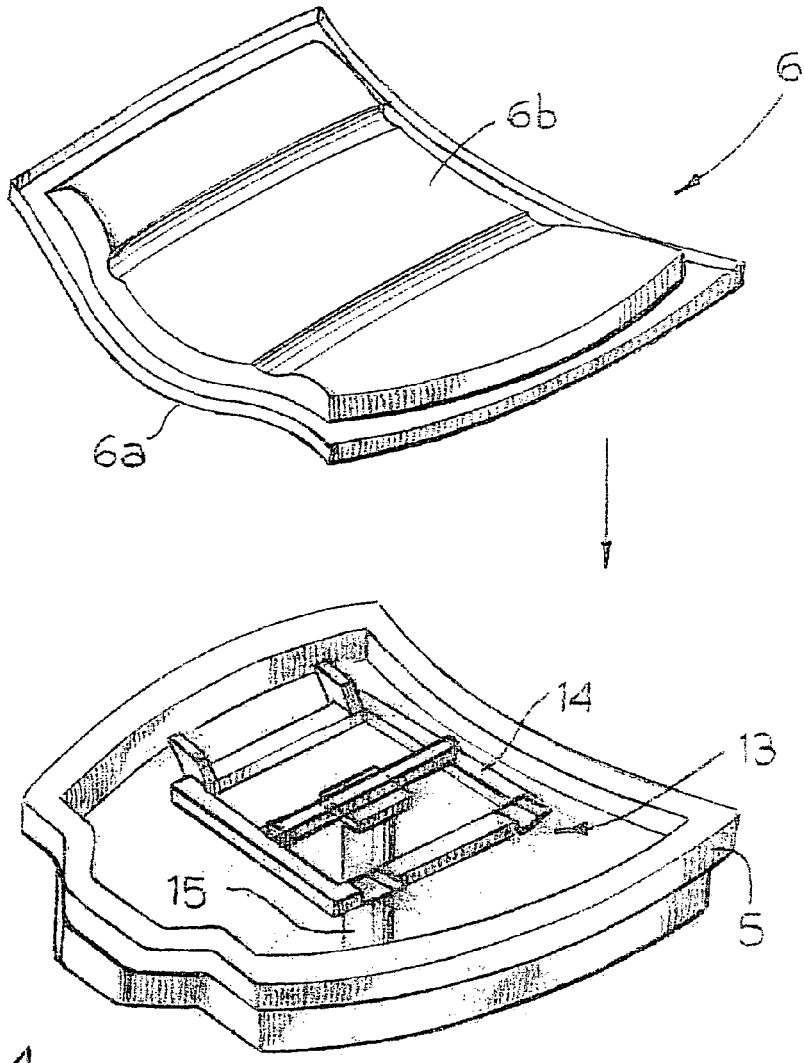
Figure 4:
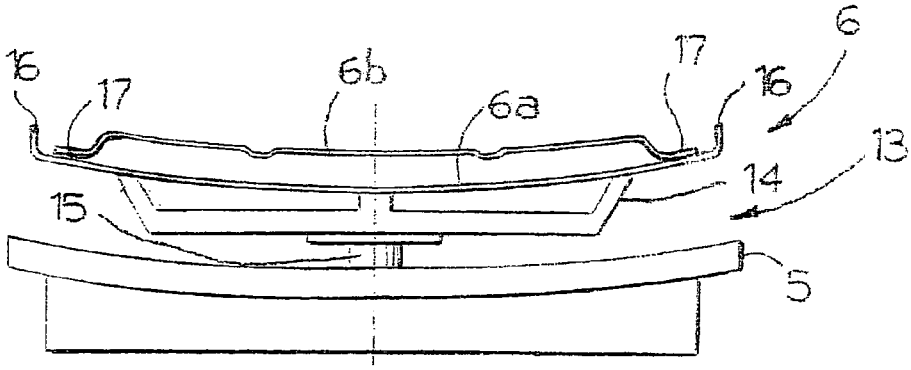

With reference to FIGS. 3 and 4, the clinching die 5 has an open central area wherein is housed a lifting device 13 including a bearing element 14 borne at the top of a cylinder 15. The bearing element 14 is movable relative to the clinching die 5 between a raised position shown in FIG. 4 and a lowered position. The structure 6 to be subjected to the clinching operation is set down on the bearing element 14 when said element is in the raised position as shown in FIG. 4.

Figure 5:
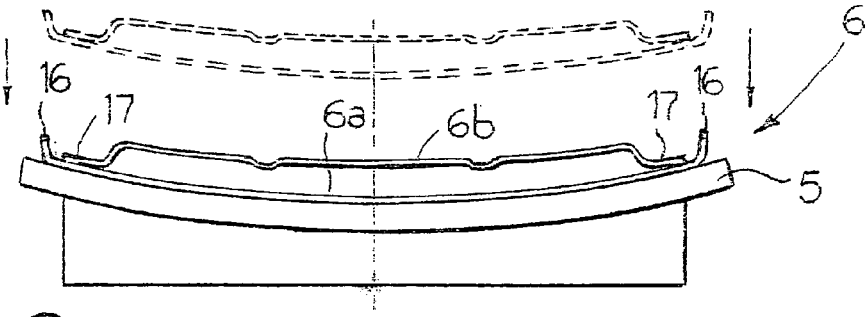

After the structure to be clinched 6 is set down on the bearing element 14, the lifter 13 is lowered as shown in FIG. 5, in such a way as to bring the structure 6 in contact with the clinching die 5. The FIGS. 4 and 5 show that the structure 6 is formed by two pieces of sheet metal 6*a* and 6*b* in contact with each other along the respective edges. The lower piece 6*a* is provided with a peripheral edge 16 which is destined to be bent against the edge 17 of the upper piece 6*b*.

Along the edges 16, 17 is spread a hot-curing resin. The hot-curing resin can be spread uniformly along the entire perimeter of the piece 6*a* before coupling with the piece 6*b*. Said application can also be performed on the clinching die.

Figure 6:
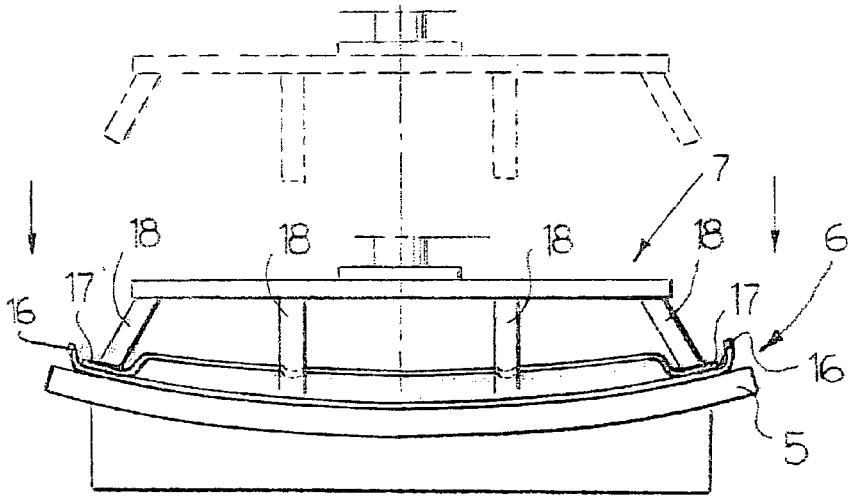

As shown in FIG. 6, after the positioning of the structure 6 on the clinching die 5 the presser 7 is lowered. The arm 18 of the presser 7 press the edge 17 of the upper piece 6*b* against the corresponding peripheral edge of the lower piece 6*a*. The presser 7 includes positioning pins for positioning the piece 6*b* with respect to the piece 6*a*. At this point, the industrial robot 11 brings the clinching tool 10 in operative position and moves the tool 10 along the entire perimeter of the structure 6 in such a way as to perform the clinching of the edge 16 of the lower piece 6*a* against the edge 17 of the upper piece 6*b*. The clinching operation can be performed as described in detail in European Patent application no. 03001105.0 mentioned above.

Figure 7:
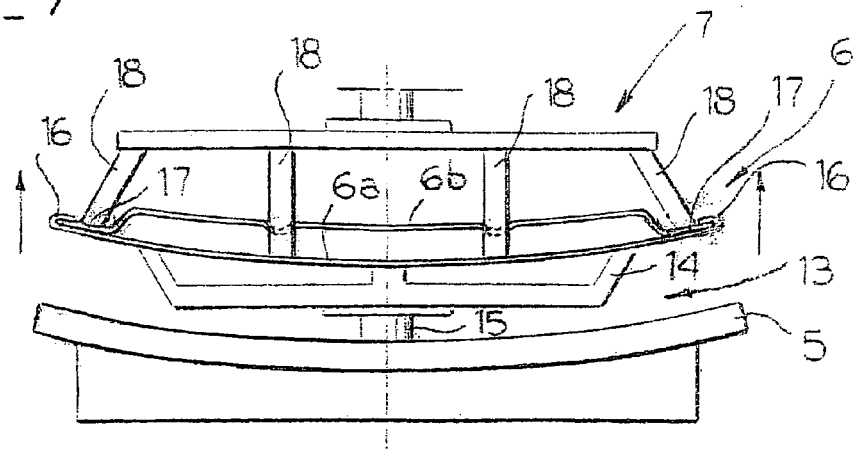

At the end of the clinching operation, the lifter 13 is brought to its raised position as shown in FIG. 7. The structure 6 is held between the presser 7 and the bearing element 14.

Figure 8:
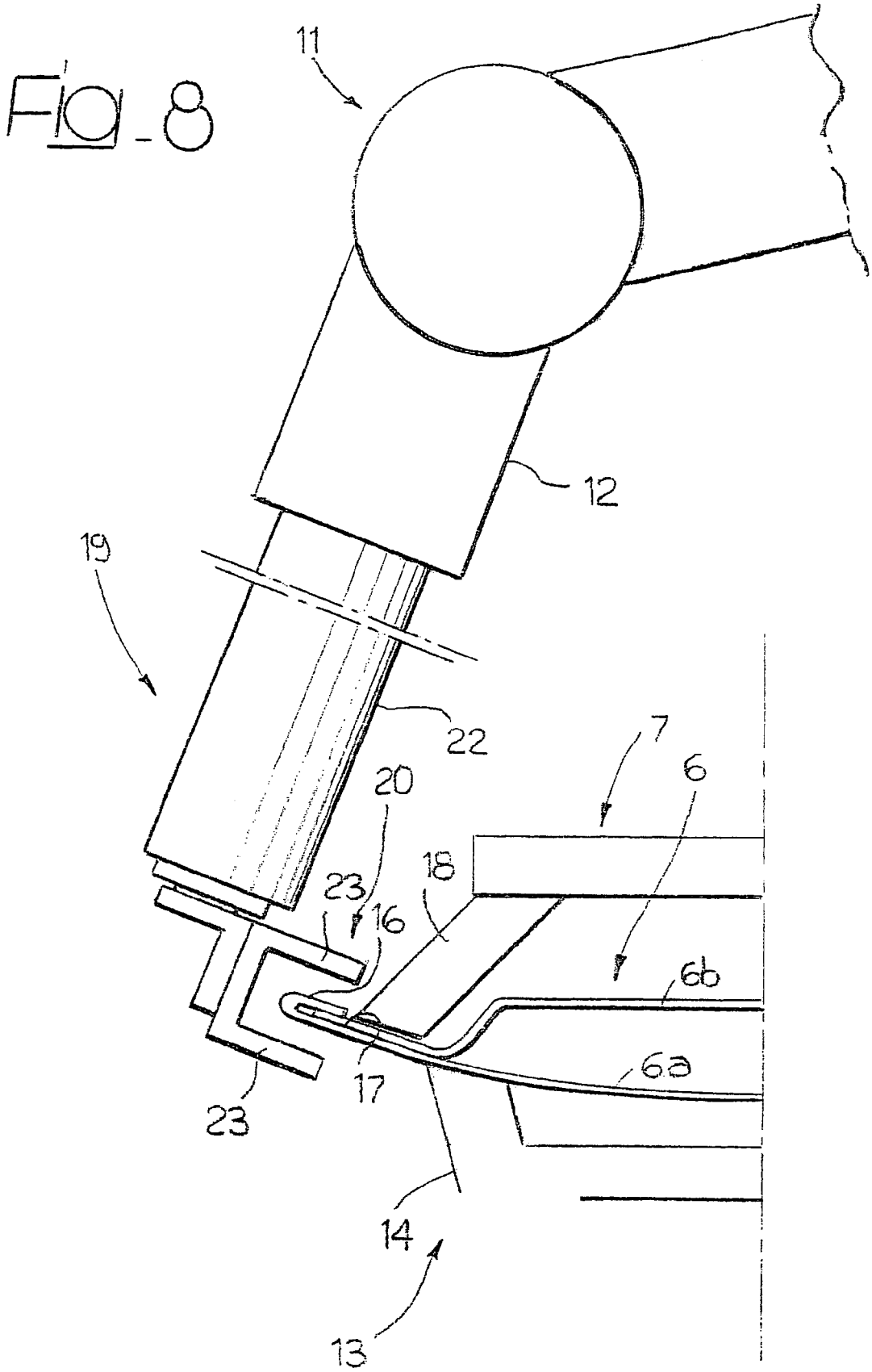

After performing the clinching operation on the edges 16, 17, the industrial robot 11 performs a tool change operation during which the clinching tool 10 is replaced with an induction heating device 19 (FIG. 8).

With reference to FIG. 8, the induction heating device 19 comprises a C-shaped heating coil 20 borne by a body 22. The body 22 is fastened to the wrist 12 of the industrial robot 11 and receives electrical power through the robot 11. The induction heating device can be of the type supplied by the British Company EFD Induction Ltd.

The heating coil 20 is positioned at the areas in which the resin is to be polymerised. The number and the position of the polymerisation areas are decided according to the dimensions and the shape of the structure 6. The robot 11 positions the coil 20 in pre-programmed areas and maintains the coil 20 in position for the time required to obtain the polymerisation of the resin. The heating coil 20 is positioned in such a way that its parallel branches 23 are at opposite sides of the clinched edges 16, 17 so that the electrical induction field produced by the device 19 is concentrated exclusively on the clinched edges 16, 17. The lifter 13 allows to detach the clinched edges 16, 17 from the clinching die 5, in order to enable the positioning of the heating coil 20 in such a way that the two branches 23 are at opposite sides with respect to the clinched edges 16, 17. The presser 7 and the bearing element 14 hold the structure 6 leaving the clinched edges 16, 17 free, in order to prevent any interference with the heating coil 20.

The coil 20 is moved in succession in all areas where the resin needs to be polymerised, whose position is known by the control unit of the robot 11. At the ends of this step, the robot 11 performs a new tool change operation during which it replaces the induction heating device 19 with the clinching tool 10. The lifter 13 remains in the raised position to receive a new structure 6 and the presser 7 is moved upwards in such a way as to free the station for the unloading operation.

It is readily apparent that with the method according to the present invention it is not necessary to provide an independent station in which to perform the resin polymerisation operation. The same robot 11 that performs the clinching operation is also used to perform the resin polymerisation operation. The heating device 19 is constructed in such a way as to be interchangeable with the clinching tool 10. The clinching tool 10 and the heating device 19 shall therefore be provided with attachment means able to cooperate with complementary attachment means provided on the wrist 12 of the robot 11.

The invention claimed is:

1. A method for clinching pieces of metal plate, comprising the steps of:

positioning two pieces of sheet metal in a clinching station, the clinching station including a support, a lifting device and a clinching die for supporting the two pieces of sheet metal during a clinching operation, the two pieces of sheet metal being provided with at least one area of their edges whereon is applied a hot-curing resin;

maintaining the two pieces of sheet metal in the clinching die with a presser applying a force to the piece of sheet metal opposite the clinching die;

performing a clinching operation by manipulating a clinching tool with a robotic arm, wherein the clinching tool is coupled to a wrist of the robotic arm, along the at least one area of the edges of said pieces; and polymerizing the resin by heating the clinched edges, wherein polymerizing comprises the steps of:

lifting the pieces of sheet metal with the lifting device to a raised position above the clinching die at the end of the clinching operation;

removing the clinching tool from the wrist;

coupling an induction heating device to the wrist; and carrying out an induction heating operation in the clinching station with the induction heating device which performs a localized heating of the clinched edges when the two pieces of sheet metal are in the raised position with respect to the clinching die.

2. The method as claimed in claim 1, wherein an industrial robot is used to move the clinching tool along the entire perimeter of the pieces to be clinched, and the same industrial robot is used to move said heating device along the entire perimeter of the pieces.

3. Method as claimed in claim 2, wherein said industrial robot is programmed to perform tool change operations to replace the clinching tool with the heating device, and vice versa.

4. The method for clinching pieces of metal plate in claim 1, wherein carrying out an induction heating operation further comprises energizing a heating coil.

5. The method for clinching pieces of metal plate in claim 4, wherein energizing a heating coil further comprises supplying electric power through the industrial robot.

6. The method for clinching pieces of metal plate in claim 4, further comprising locating a portion of the heating coil parallel to one another on a top and a bottom side of the at least a portion of the clinched edges.

7. The method for clinching pieces of metal plate in claim 6, wherein the heating coil is C-shaped.

8. The method for clinching pieces of metal plate in claim 1, wherein the clinched edges form a portion of a vehicle door.

9. The method of claim 1, further comprising placing the two pieces of sheet metal on the lifting device when the lifting device is in the raised position, then lowering the lifting device and performing the clinching operation.

10. The method of claim 1, further comprising manipulating the presser with an arm attached to a central column.

11. The method of claim 10, wherein the robotic arm is attached to a top of the central column.

12. A method for clinching pieces of metal plate, comprising the steps of:

providing an installation for producing vehicle doors having a central column, at least one clinching station, a presser, and a robotic arm;

lifting a bearing element from the interior of a clinching die to a raised position above the clinching die;

placing two pieces of sheet metal on the bearing element when the bearing element is in the raised position;

lowering the bearing element and thereby placing the two pieces of sheet metal onto the clinching die;

moving the presser vertically into engagement with the uppermost piece of sheet metal, wherein the presser is coupled to and manipulated from the central column;

applying a polymerizing resin to at least a portion of the perimeter edges of the two pieces of sheet metal;

manipulating a clinching tool with a wrist coupled to the robotic arm in order to clinch the perimeter edges of the two pieces of sheet metal;

lifting the bearing element and the two pieces of sheet metal back to the raised position; and polymerizing the resin by carrying out an induction heating operation to the polymerizing resin while the two pieces of sheet metal are in the raised position.

13. The method of claim 12, further comprising removing the clinching tool from the wrist and coupling the induction heating device to the wrist automatically.

14. The method of claim 13, wherein the robotic arm is coupled to and manipulating from a top of the central column.

15. The method of claim 13, further comprising providing electric power to the clinching tool and the induction heating device through the robotic arm.

16. The method of claim 15, wherein the induction heating device is a heating coil.

17. The method of claim 16, further comprising locating two portions of the heating coil parallel to one another, wherein one portion is located above the two pieces of sheet metal and the other portion is located below the two pieces of sheet metal.

* * * * *